United States Patent [19]

Ritts

[11] Patent Number: 4,912,859

[45] Date of Patent: Apr. 3, 1990

[54] SPRING SHOE

[76] Inventor: Gary Ritts, 2340 N. Cahuenga Blvd., Los Angeles, Calif. 90068

[21] Appl. No.: 300,493

[22] Filed: Jan. 23, 1989

[51] Int. Cl.[4] ..... A43B 3/10; A43B 13/18

[52] U.S. Cl. ..... 36/7.8; 272/114

[58] Field of Search ..... 36/27, 28, 29, 102, 36/132, 136, 7.8; 272/114

[56] References Cited

U.S. PATENT DOCUMENTS

| | | | |
|---|---|---|---|
| 1,613,538 | 1/1927 | Schad | 36/7.8 |
| 2,475,092 | 7/1949 | Harrell | 36/7.8 |
| 3,205,596 | 9/1963 | Hoffmeister | 36/7.8 |
| 3,219,358 | 11/1965 | Hagner | 36/7.8 X |
| 4,196,903 | 4/1980 | Illustrnto | 272/114 |
| 4,660,299 | 4/1987 | Omilusik | 36/7.8 |

*Primary Examiner*—Donald Watkins

*Attorney, Agent, or Firm*—Freilich Hornbaker Rosen & Fernandez

[57] ABSTRACT

A spring shoe is provided, of the type which includes a top plate that holds a person's foot and a bottom plate coupled to the top plate through springs to allow for vigorous jumping, wherein the top plate is stabilized against unwanted motion in a simple and rugged mechanism. An elongated cross bar is provided which has a front end hinged to the front of the top plate and a rear end hinged to the rear of the bottom plate. The cross bar permits vertical motion and pitch of the top plate with respect to the bottom plate, while avoiding other unwanted motions of the top plate such as longitudinal and lateral shifting and tilting in roll.

6 Claims, 1 Drawing Sheet

FIG. 1
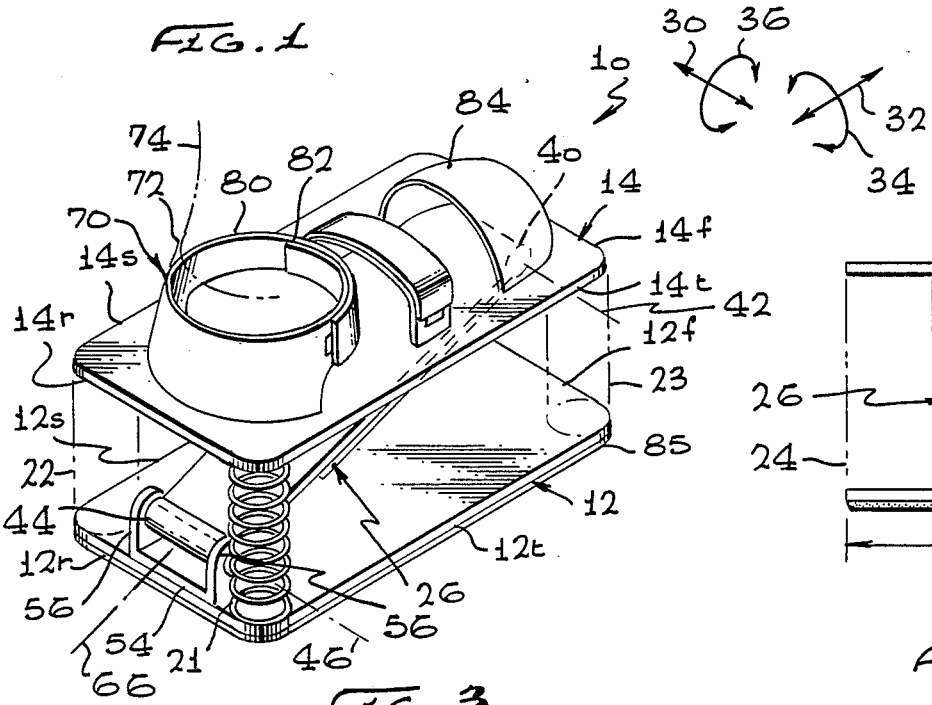
FIG. 3
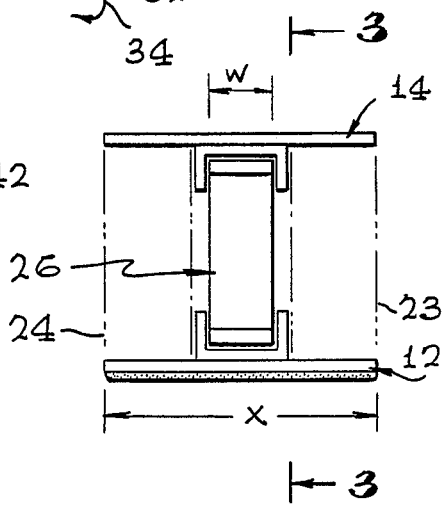
FIG. 2
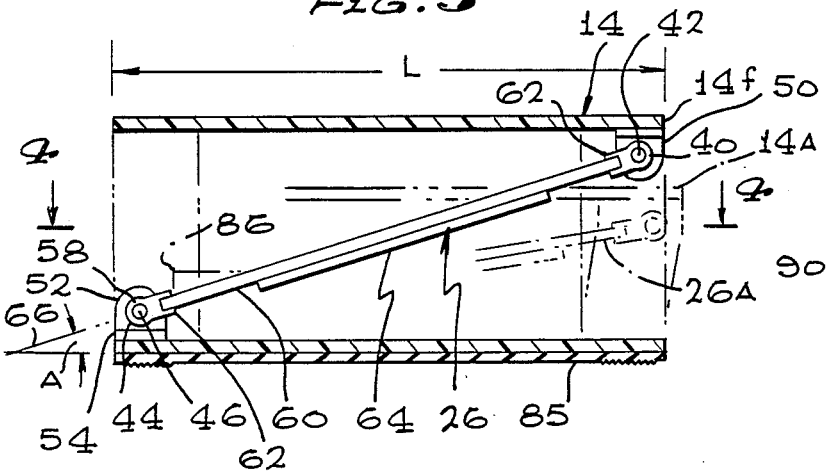
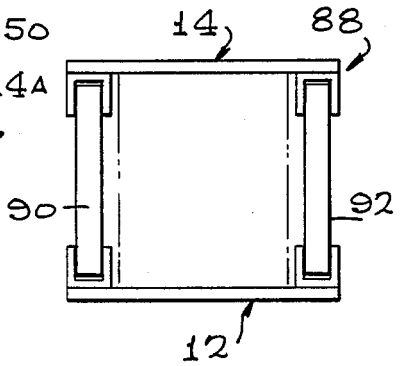
FIG. 5
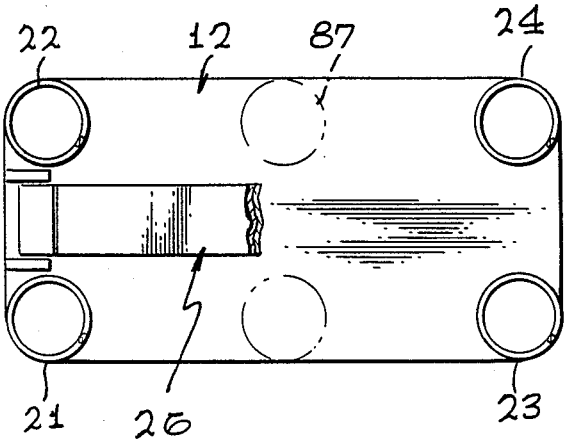
FIG. 4
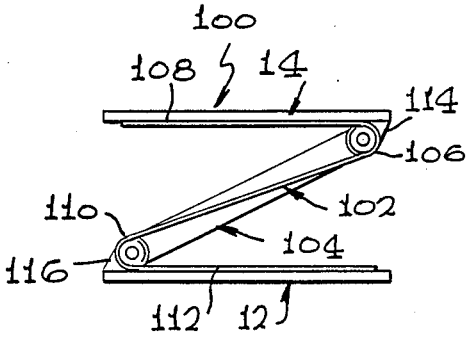
FIG. 6

SPRING SHOE

BACKGROUND OF THE INVENTION

A spring shoe usually includes vertically spaced top and bottom plates and springs between them. A person fastens his foot (which may have a shoe thereon) to the top plate and can exercise or have fun by using the spring shoe to jump. If an additional stabilizing device is not provided, the top plate has poor stability, in that it can easily shift laterally (from side to side) or longitudinally (forward and rearwardly) with respect to the bottom plate. Also, the top plate can tilt in roll (one side moves down and the other up). Spring shoes are easier to use if motion of the top plate with respect to the bottom plate is limited to vertical motion to provide the spring-aided jump effect, and to tilting in pitch (where the front tilts up or down) to facilitate control of forward and rearward movement. U.S. Pat. No. 1,613,538 by Schad shows a stabilizing mechanism which includes four 2-bar linkages, with each linkage coupling the top and bottom plates. While such linkages resist sideward shifting of the top plate, they do not resist longitudinal shifting or roll of the top plate. Also, such linkages are relatively expensive and fragile because of the numerous lightweight pivot joints. A rugged stabilizing mechanism for a spring shoe, which resisted substantially all motion of the top plate relative to the bottom plate except vertical motion and pivoting in pitch, and which was of relatively simple and rugged construction, would facilitate the provision of easy-to-use spring shoes.

SUMMARY OF THE INVENTION

In accordance with one embodiment of the present invention, a spring shoe is provided which stabilizes the top plate against unwanted movement, in a rugged and low cost construction. The spring shoe includes vertically spaced top and bottom plates and springs for resiliently biasing them apart. The top plate is stabilized by a cross bar having one end pivotally connected to an end of the top plate such as its front end, the cross bar having another end pivotally connected to an opposite end of the bottom plate such as its rear end. The cross bar provides stability for the top plate, while still permitting vertical movement and pivoting in pitch.

The novel features of the invention are set forth with particularity in the appended claims. The invention will be best understood from the following description when read in conjunction with the accompanying drawings.

BRIEF DESCRIPTION OF THE DRAWINGS

FIG. 1 is a rear perspective view of a spring shoe constructed in accordance with one embodiment of the present invention.

FIG. 2 is a front elevation view of the spring shoe of FIG. 1, without the foot engaging device.

FIG. 3 is a sectional view taken on the line 3—3 of FIG. 2.

FIG. 4 is a view taken on the line 4—4 of FIG. 3.

FIG. 5 is a front elevation view of a spring shoe constructed in accordance with another embodiment of the invention.

FIG. 6 is a side view of a spring shoe constructed in accordance with another embodiment of the invention.

DESCRIPTION OF THE PREFERRED EMBODIMENTS

FIG. 1 illustrates a spring shoe 10 which includes a bottom plate 12 and a top plate 14 lying over the bottom plate to be vertically spaced from its. The plates are biased apart by a spring means which includes four coil springs 21-24. The top plate has front and rear end portions **14*f*, 14*r* and opposite sides 14*s*, 14*t* while the bottom plate similarly has front and rear end portions 12*f*, 12*r* and opposite sides 12*s*, 12*t*. The springs are arranged at opposite sides of the front and rear end portions and extend substantially vertically. A cross bar 26** stabilizes the top plate against unwanted motions.

The spring shoe could be used even in the absence of the cross bar 26, but it would then operate in a less controllable manner. The top plate could shift in a horizontal direction 30 towards its opposite side, or in a longitudinal direction 32 (perpendicular to 30) extending between the front and rear portions of the top plate. The top plate could also pivot in roll movement indicated by arrow 34. The cross bar 26 stabilizes the top plate against such unwanted movement, while permitting the top plate to move vertically and to pivot in pitch, wherein it pivots about a lateral axis or direction 30, as indicated by the pitch arrow 36. Vertical movement is, of course, necessary for spring action, while tilting in pitch (arrow 36) is desirable to enable a person to control movement in forward and rearward directions.

The cross bar has a first or front end 40 coupled to the front end portion **14*f* of the top plate to permit pivoting of the cross bar about a first lateral axis 42 relative to the top plate. Similarly, the cross bar has a second or rear end 44 that is coupled to the rear end portion of the bottom plate to permit pivoting about a second lateral axis 46. Pivotal connection at the opposite ends of the cross bar is made through hinge joints 50, 52 (FIG. 3) that each include a mount 54 (FIG. 1) with outstanding flanges 56, and a hinge pin 58 passing through the flanges and through a hole in a corresponding end of the cross bar. The cross bar can have the construction indicated in FIG. 3, wherein it includes a main bar portion 60 with connectors 62 at its ends, and with a stiffener 64 along its middle. The configuration shown in solid lines in FIG. 3 is a configuration assumed when there is substantially no weight on the top plate. When the spring shoe hits the ground after a jump, the top plate may descend to a lowered position indicated at 14A. The cross bar has pivoted to the position 26A** wherein it has moved the top plate slightly forward.

The top plate initially extends at a relatively small angle A such as 20° from the horizontal, so that its downward pivoting to the position 26A results in only a small forward shift of the top plate. To assure such a small angle A and the consequent small forward movement of the top plate, the top plate is constructed so its length, as measured between the first and second lateral axes 42, 46 is made long, preferably more than three-quarters the length L of the top and/or bottom plates. To resist lateral shifting and roll of the top plate, the cross bar is provided with a considerable width W (FIG. 2) which is more than 10% of the width X of the top and bottom plates to stiffen it against sideward bending (which would allow lateral shift of the top plate) and against twisting about a bar axis 66. It may be noted that the cross bar is not subjected to upward or downward bending of its front end relative to its rear end. However, it is subject to compression along its length, and the stiffener 64 helps resist column collapse.

FIG. 1 illustrates a foot engaging device 70 for engaging the shoe 70 of a wearer 74. The device includes a rear strap assembly 80 which is mounted on the top plate 14 and which has Velcro-joined straps 82 for fitting around the ankle of the wearer. The device also includes Velcro-joined arch straps 83 and a toe holder 84 which also mount on the top plate. A rubber sole 85 mounts on the bottom plate to increase traction. It should be noted that top and bottom plates 14, 12 are not necessarily of a simple plate shape, but generally have a greater width and length than their average thickness. It also may be noted that springs could instead be mounted to extend from an end of a plate to a mount (such as at 86 in FIG. 3) on an end of the cross bar, and that springs could be mounted at the middle of the plates (as at 87 in FIG. 4). Springs of different wire diameters and consequent different spring rates can be used for persons of different weights.

FIG. 5 illustrates a spring shoe 88 of another embodiment of the invention, wherein stabilization is achieved with two cross bars 90, 92 lying at opposite sides of the spring shoe, with each bar extending between the front end portion of the top plate 14 and the rear end portion of the bottom plate 12. In this spring shoe, two springs 94 are employed, one at the rear between the two cross bars, and one at the front between the two cross bars. While this arrangement can provide somewhat greater lateral stability, it results in additional cost, due to the use of two additional hinge joints. Also, if the coil spring is of too great a diameter, it will resist the slight bending required to accommodate slight forward movement of the top plate as it moves downward. Of course four springs, each of smaller diameter, can be used instead.

FIG. 6 illustrates a spring shoe 100 of another embodiment of the invention, wherein a double torsion spring assembly 102 is placed at each side of the spring shoe with a cross bar 104 between the spring assemblies. Each spring assembly includes a upper torsion spring portion 106 at the front portion of the top plate 14, with a spring end 108 biased against the bottom of the top plate, and with a rear torsion spring portion 110 with an end 112 biased against the bottom plate 12. The cross bar 104 is similar to that of FIG. 1, except that it includes stop portions 114, 116 at its end that can abut the top and bottom plates to limit pivoting of the top and bottom plates to substantially parallel orientations when no weight is on them. As in the other embodiments of the inventions, the cross bar 104 stabilizes the top plate against unwanted motion while permitting vertical movement and pivoting in pitch. Coil springs can be used in addition to the torsion springs.

Thus, the invention provides a spring shoe of relatively simple and rugged design, which stabilizes the top plate against unwanted movement. This is accomplished by a cross bar having a first end pivotally coupled to one end portion of the top plate and a second end pivotally coupled to an opposite end portion of the bottom plate. The cross bar is preferably long to extend at a low angle of not more than about 30° from the horizontal to minimize longitudinal movement of the top plate as it moves vertically. The cross bar also has a substantial width which is preferably at least about 10% of the width of the plates (the combined width of all cross bars).

Although particular embodiments of the invention have been described and illustrated herein, it is recognized that modifications and variations may readily occur to those skilled in the art and consequently it is intended to cover such modifications and equivalents.

What is claimed is:

1. A spring shoe apparatus comprising:

a bottom plate having opposite first and second end portions spaced apart along a longitudinal direction;

a top plate lying over said bottom plate and spaced therefrom, said top plate having a foot engaging device that holds to a wearer's foot, said top plate having opposite first and second end portions lying respectively over and spaced from said first and second end portions of said bottom plate;

spring means coupling said top and bottom plates and resiliently biasing apart both their first end portions and their second end portions;

a cross bar having a first end coupled to said first end portion of said top plate to pivot about a first axis on said top plate, and having a second end coupled to said second end portion of said bottom plate to pivot about a second axis on said bottom plate, said first and second axes extending substantially perpendicular to said longitudinal direction and parallel to each other, said cross bar being rigid to resist twisting and sideward bending.

2. The apparatus described in claim 1 wherein:

said top and bottom plates each have opposite sides spaced apart along a lateral direction that is perpendicular to said longitudinal direction;

said spring means includes a pair of first coil springs lying on opposite sides of said first end of said cross bar and with each extending between said top and bottom plates, and a pair of second coil springs lying on opposite sides of said second end of said cross bar and with each extending between said top and bottom plates.

3. The apparatus described in claim 1 wherein:

said bar has a length great enough that it extends at an angle of less than 30° from the horizontal when said top and bottom plates lie in substantially horizontal planes and there is no weight on said top plate, whereby to minimize longitudinal movement of the top plate.

4. The apparatus described in claim 1 wherein:

said cross bar has a width of more than 10% of the maximum width of said top plate.

5. A spring shoe apparatus comprising:

a bottom plate having first and second opposite end portions spaced apart in a longitudinal direction and first and second opposite side portions spaced apart in a lateral direction extending perpendicular to said longitudinal direction;

a top plate vertically spaced from said bottom plate, said top plate having means for holding to a foot of a wearer, said top plate having first and second opposite end portions lying respectively over said top plate first and second end portions and having first and second opposite sides lying respectively over said top plate first and second sides;

a cross bar with first and second ends, and extending between said top and bottom plates;

first and second hinge joints, said first hinge joint connecting said first end of said cross bar to said first end portion of said top plate in a joint that allows relative pivoting substantially only about a first axis extending in said lateral direction, said second hinge joint connecting said second end of said cross bar to said second end portion of said bottom plate in a joint that allows relative pivoting substantially only about a second axis extending parallel to said first axis;

a plurality of coil springs, each extending substantially vertically between corresponding end portions of said top and bottom plates and each coil spring being laterally spaced from an adjacent end of said cross bar.

6. The apparatus described in claim 4 wherein:

said cross bar has a length greater than three-quarters the length of said top plate and extends at an angle of no more than about 30° from the horizontal when said bottom plate rests on a horizontal surface and there is no weight on said top plate.

* * * * *